US006152785A

United States Patent [19]

Haller et al.

[11] Patent Number: 6,152,785

[45] Date of Patent: Nov. 28, 2000

[54] BATTERY TERMINAL POST CONNECTOR

[75] Inventors: Lisa K. Haller, Anderson; James M. Murphy, Chesterfield; Richard Demas Watson, Anderson, all of Ind.

[73] Assignee: Delphi Technologies, Inc., Troy, Mich.

[21] Appl. No.: 09/447,649

[22] Filed: Nov. 23, 1999

[51] Int. Cl.[7] ..... H01R 4/38

[52] U.S. Cl. ..... 439/766

[58] Field of Search ..... 439/758, 766, 439/770, 765, 754, 801, 860, 868, 883

[56] References Cited

U.S. PATENT DOCUMENTS

| | | | |
|---|---|---|---|
| 1,175,651 | 3/1916 | Marko . | |
| 1,565,786 | 12/1925 | Burkholder . | |
| 3,973,820 | 8/1976 | Benson | 439/726 |
| 4,936,799 | 6/1990 | Woodall | 439/755 |
| 5,486,434 | 1/1996 | Aoyama | 429/178 |
| 5,620,338 | 4/1997 | Stephens et al. | 439/522 |

*Primary Examiner*—Gary F. Paumen
*Assistant Examiner*—Edwin A. León
*Attorney, Agent, or Firm*—Margaret A. Dobrowitsky

[57] ABSTRACT

The present invention comprises a battery terminal post connector comprising a device which makes direct contact with a storage battery terminal (post) extending outwardly from a battery case. The terminal post connector includes a conductor plate and a sleeve which is received within an opening formed in the conductor plate. The sleeve is secured to the conductor plate by conventional techniques, such as welding. The sleeve comprises a body having a plurality of fingers and a plurality of slots, wherein each finger is defined by a pair of slots. The sleeve has a central opening which receives a tapered post terminal extending from the battery case. A portion of an outer surface of the sleeve is threaded and is intended to threadingly engage a fastener, wherein threading the fastener to the sleeve results in the sleeve being intimately seated against the post terminal. The fastener preferably comprises a tapered nut having a first inner thread diameter and a second inner thread diameter, wherein the first inner thread diameter is greater than the second inner thread diameter.

17 Claims, 1 Drawing Sheet

BATTERY TERMINAL POST CONNECTOR

TECHNICAL FIELD

The present invention relates generally to electrical storage batteries and more particularly, to a battery terminal post connector for electrical storage batteries in which the battery terminal post connector is particularly well suited for electrically connecting an electrical conduit to a post battery terminal.

BACKGROUND OF THE INVENTION

Storage batteries of the type used in automobiles, trucks and the like generally have terminal posts made of a conductive material, e.g., a lead alloy material, with a cylindrical or frusto-conical shape. A variety of types of terminal connectors are available to connect an electrical conduit to the battery in vehicle type applications. Some of those include a conventional connector comprising a molded, generally U-shaped device with a bolt passing through the outwardly projecting yoke-like arms for securely clamping the connector to the battery post. Such connectors are usually die cast from lead or brass-lead alloy or other materials such as zinc alloy or copper alloy.

Unfortunately, many of the conventional terminal connectors are relatively large and bulky and some of the terminal connectors are more complex to manufacture and require numerous parts and operations. Another concern is that as vehicles have become more compact and streamlined with added attention to aerodynamics, the space available for placement of the battery under the hood or elsewhere has become more limited. Moreover, due to the space and constraints, it is difficult with conventional terminal connectors to electrically connect a flat electrical conductor to standard vehicle battery posts having tapered designs in a compact and effective manner. Another of the associated disadvantages of conventional battery terminal connectors is that the connectors are fairly tolerance dependent. In other words, if the terminals of the battery have slightly varying dimensions, then the battery terminal connectors may not be able to be easily and securely attached to the battery terminal due to these varying tolerances. Thus, the terminal connector may not be able to be used with a given battery which has a tolerance variation or there will not be a strong mechanical and electrical connection made between the terminal connector and the battery terminal because of poor coupling between the two components.

As more and more electrical components, e.g., an electronics package, are being used and integrated into vehicles and the like, the need likewise increases for a compact and effective battery terminal connector which will permit and support one or more electronics packages which are electrically connected to the battery.

SUMMARY OF THE INVENTION

The present invention comprises a battery terminal post connector comprising a device which makes direct contact with a tapered storage battery terminal (post) extending outwardly from a battery case. The terminal post connector includes a conductor plate and a sleeve which is received within an opening formed in the conductor plate. The sleeve is secured to the conductor plate by conventional techniques, such as welding. The sleeve comprises a body having a plurality of fingers and a plurality of slots, wherein each finger is defined by a pair of slots. The sleeve has a central opening which receives the tapered post terminal extending from the battery case. A portion of an outer surface of the sleeve is threaded and is intended to threadingly engage a fastener. The fastener preferably comprises a tapered nut having a first inner thread diameter and a second inner thread diameter, wherein the first inner thread diameter is less than the second inner thread diameter.

After the tapered post terminal is received within the sleeve opening, the fastener threads having the first inner diameter contact and threadingly engage the outer threads of the sleeve as the fastener is rotated. As the tapered nut is tightened, the plurality of fingers radially converge inward and seat against the outer surface of the tapered post terminal. Due to the tapered nature of the post terminal, the tapered nut will only be capable of being threaded to a predetermined point of outer threads where the diameter of the first inner threads of the tapered nut is less than the outer diameter of the threads formed on the outer surface of the sleeve.

The terminal connector further includes a snap-on cover which is formed of an insulating material such as a plastic material. The cover attaches to the conductor plate so that it encloses the post terminal when it is securely attached to the conductor plate in a snap-fit manner. A portion of the cover includes a lip which snap-fittingly engages the peripheral edge of the conductor.

The terminal connector of the present invention is intended to mechanically hold down and electrically connect an electronics package to the battery terminal while still permitting access to the battery terminal if the user has a need to form another electrical connection between the battery terminal and an electrical conduit. In another aspect, the terminal connector has a smaller "footprint" for current carrying capability in comparison to conventional terminal connectors. Consequently, the terminal connector of the present invention occupies less space and may be used in a greater variety of locations because of its compactness.

The above-described and other features and advantages of the present invention will be appreciated and understood by those skilled in the art from the following detailed description, drawings, and appended claims.

BRIEF DESCRIPTION OF THE DRAWINGS

Referring now to the drawings wherein like elements are numbered alike in the several Figures.

DETAILED DESCRIPTION OF THE PREFERRED EMBODIMENT

Figure 1:
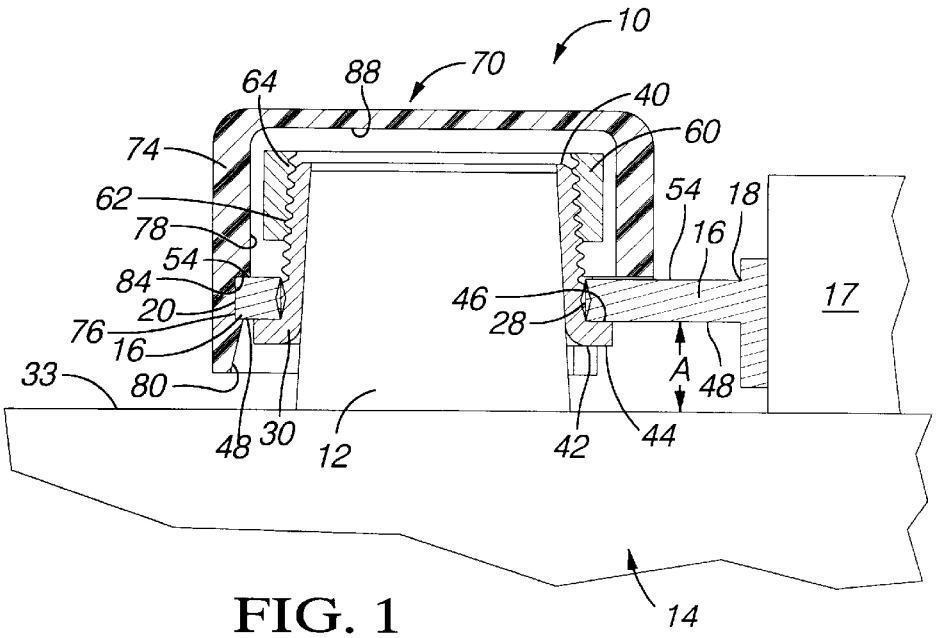
FIG. 1 is a partial cross-sectional side elevation view of a battery terminal post connector according to the present invention.

Referring to FIG. 1, an exemplary embodiment of a battery terminal post connector according to the present invention is generally designated by reference numeral 10. Post connector 10 comprises a device which makes direct contact with a storage battery terminal (post) 12 extending outwardly from a battery case 14. In the illustrated embodiment, terminal 12 is in the form of a tapered post. It is understood that post terminal 12 comprises either a positive terminal or a negative terminal and for the purpose of simplicity and illustration, post terminal 12 will be discussed herein generally without reference to whether post terminal 12 comprises the positive or the negative terminal of battery case 14. As is known, the principle difference between the positive terminal and the negative terminal of a conventional battery case 14 is that the diameter of the post differs between the two. The shape of the positive and negative post terminals is essentially identical except for the noted difference in diameter.

Figure 2:
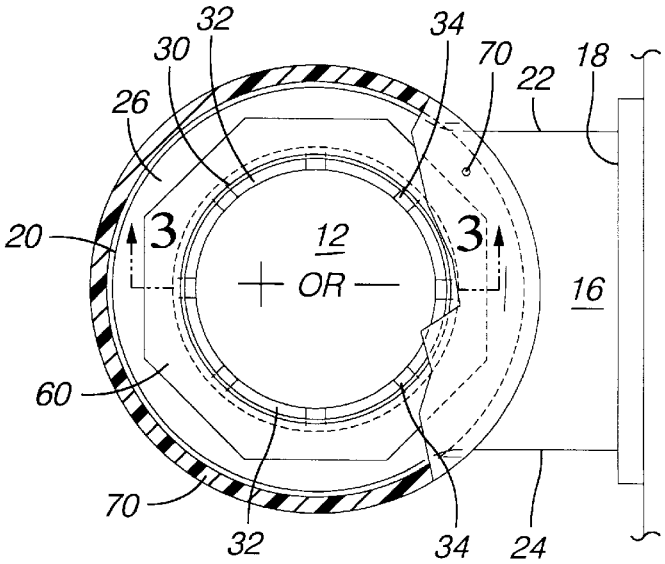
FIG. 2 is a top plan view of the battery terminal post connector of FIG. 1 illustrating a cover partially broken away.
Figure 3:
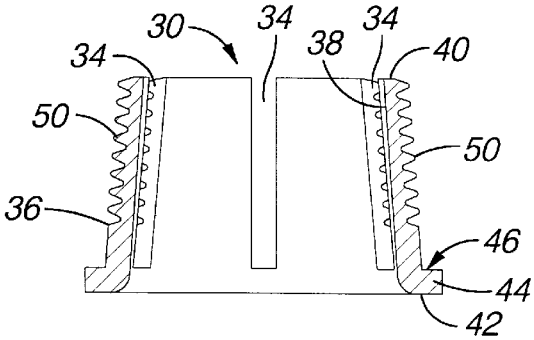
FIG. 3 is an enlarged cross-sectional view of a sleeve used in the battery terminal post connector taken in the direction 3—3 of FIG. 2.

Referring to FIGS. 1–3, post connector 10 includes a conductor 16 having a first end 18 and an opposite second end 20. Conductor 16 is formed of any suitable conductive material and in a preferred and exemplary embodiment is formed of copper or brass. As best shown in FIG. 2, conductor 16 comprises a conductor plate having opposing first and second side edges 22 and 24 which are substantially parallel to one another at first end 18. Intermediate first and second ends 18 and 20, side edges 22 and 24 flare outwardly in an arcuate manner to form a generally circular platform indicated generally at 26. It being understood that side edges 22 and 24 arcuately converge with one another distal to end 18 to form generally circular platform 26. Intermediate first and second ends 18 and 20, conductor 16 includes an opening 28 formed therein. Opening 28 is preferably circular in shape. It being understood that opening 28 is generally formed in circular platform 26 and the surface area of conductor 16 from the outer perimeter of opening 28 to second end 20 is greater than the area from the outer perimeter of opening 28 to first end 18. Extending between a peripheral edge defining opening 28 and an outer peripheral edge defining circular platform 26 is a strip of circular platform 26.

The design of conductor 16 and more specifically, generally circular platform 26, is such that terminal connector 10 provides a smaller "footprint" for the current carrying capability in comparison with conventional terminal connectors. Because of the smaller footprint, terminal connector 10 provides a compact design which occupies less space than the conventional terminal connectors do. This permits terminal connector 10 to be used in a greater variety of locations within the automobile or another location where battery case 14 is disposed.

At first end 18, conductor 16 may be electrically connected to an electrical distribution assembly, such as a bus bar assembly, or may be attached to an electrical cable assembly to route power from post terminal 12 of battery 14. In a preferred embodiment, conductor 16 is connected to an electronic package generally indicated at 17. Electronics package 17 includes electrical and mechanical components (not shown) disposed therein which require power in order for electronics package 17 to operate. For example, electronics package 17 preferably includes one or more bus bar assemblies (not shown) which distribute power from battery case 14 through terminal 12 to the electrical components of electronics package 17. In the illustrated embodiment shown in FIG. 1, conductor 16 is electrically connected to an internal bus bar assembly disposed within electronics package 17. It will be appreciated that conductor plate 16 may alternatively be attached to battery cables, which are typically used to attach to top post batteries. Therefore, the present invention is not limited to attachment to an electronics package 17.

Post connector 10 further includes a sleeve 30 which is disposed within opening 28 and is securely coupled to conductor 16 so that sleeve 30 outwardly extends from conductor 16. As best shown in FIG. 2, sleeve 30 is formed of a plurality of clamp fingers 32 and a plurality of spaced slots 34 formed within clamp 30, wherein each of fingers 32 is defined by a pair of slots 34. Each of the plurality of fingers 32 has an outer surface 36 and in an exemplary embodiment, sleeve 30 is generally circular is shape so that is complementary to and intimately received within opening 28 and secured to conductor 16. Sleeve 30 has a central opening 38 which is sized to receive post terminal 12 of battery 14. Accordingly, sleeve 30 may be referred to as a split finger sleeve.

More specifically, sleeve 30 has a first end 40 and an opposing second end 42, wherein second end 42 comprises an outwardly flared end defined by an outwardly flared annular flange 44. As best shown in FIG. 1, outwardly flared annular flange 44 forms a shoulder 46 which is intended to abut against the peripheral edge of opening 28 of conductor 16 when sleeve 30 is securely disposed within opening 28. In other words, outwardly flared annular flange 44 acts as a stop when sleeve 30 is disposed within opening 28 so that conductor 16 seats against surface (shoulder 46) and outer surface 36 of sleeve 30 proximate second end 42.

In accordance with the present invention, sleeve 30 is securely coupled to conductor 16 at second end 42 thereof. Any number of suitable techniques may be used to securely couple sleeve 30 to conductor 16 and more specifically, securely couple outwardly flared annular flange 44 to a bottom surface 48 of conductor 16 so that conductor 16 seats within shoulder 46 and is secured thereto. For example, one exemplary securing technique comprises using a welding process to securely couple sleeve 30 to conductor 16. One preferred technique is an inertia weld process. As is known in the art, in an inertia weld process, the components to be joined, namely, sleeve 30 and conductor 16 are held in axial alignment with respect to one another. One component (e.g., conductor 16) is held stationary while the other component (e.g., sleeve 30) is driven rotationally and thrust against the stationary component (conductor 16), heating the circular interface by friction and plastically extruding metal. As a result of this process, rotation is stopped and thrust is increased to forge-bond the components (sleeve 30 and conductor 16) together. Accordingly, the interface between conductor 16 and sleeve 30 is characterized as being securely welded together in this exemplary embodiment.

Outer surface 36 of sleeve 30 includes a plurality of threads 50 being formed therein for threadingly engaging a fastener 60. In other words, threads 50 are formed on outer surface 36 of each of fingers 32. As best shown in FIG. 2, threads 50 extend from first end 40 of sleeve 30 to a predetermined location of outer surface 36 proximate second end 42. Preferably the bottommost thread with respect to conductor 16 is disposed slightly above or generally orientated adjacent a top surface 54 of conductor 16 when sleeve 30 is securely coupled to conductor 16, as shown in FIG. 2.

The inner diameter of sleeve 30 is substantially the same at first end 40 as it is at second end 42 prior to fastener 60 being threadingly engaged thereto at first end 40. Thus, the inner diameter of sleeve 30 is selected so that post terminal 12 may be received within opening 38 at second end 42 and because of its tapered nature, post terminal 12 will only be received partially within sleeve 30. In other words, as post terminal 12 is received within opening 38 of sleeve 30, sleeve 30 encounters a location of post terminal 12 where the inner diameter of sleeve 30 at second end 42 is less than an outer diameter of post terminal 12 thereby preventing continued downward movement of sleeve 30 toward battery case 14. When post terminal 12 is disposed through opening 38 and is properly located therein, the topmost portion of post terminal 12 preferably extends to or slightly above first end 40 of sleeve 30. In addition, as best shown in FIG. 1, when sleeve 30 is secured to post terminal 12, second end 42 of sleeve 30 is disposed at a distance A from a top surface 33 of battery case 14.

Sleeve 30 is secured to post terminal 12 by threadingly engaging fastener 60 with threads 50 formed on outer surface 36 of the plurality of fingers 32 forming sleeve 30. In the illustrated exemplary embodiment, fastener 60 comprises a tapered nut which is preferably formed of plated steel. Fastener 60 has a first inner thread diameter 62 and a second inner thread diameter 64, wherein first inner thread diameter 62 is greater than second inner diameter 64. When fastener 60 threadingly engages sleeve 30, the threads having the first inner thread diameter 62 initially contact and engage threads 50 of sleeve 30.

Because of the split finger nature of sleeve 30, as fastener 60 threadingly engages sleeve 30, the torquing of fastener 60 causes first end 40 of sleeve 30 to inwardly converge resulting in the plurality of fingers 32 being forced inward towards battery terminal 12. In other words, the plurality of slots 34 formed in clamp 30 permits the plurality of fingers 32 to converge with respect to one another causing first end 40 to seat against the outer surface of the tapered top end of post terminal 12, as illustrated in FIG. 1. Initially the first inner thread diameter 62 of fastener 60 is greater than the outer diameter of threads 50 formed on outer surface 36 of clamp 30 at first end 40, and thus, fastener 60 easily receives sleeve 30 and threadingly engages first end 40 of sleeve 30. As fastener 60 threadingly engages sleeve 30, the plurality of fingers 32 are inward radially forced against post terminal 12. In addition, fastener 60 will be prevented from threadingly engaging the bottommost threads of sleeve 30 adjacent shoulder 46 due to the tapered nature of post terminal 12, sleeve 30, and fastener 60. Thus, fastener 60 will reach a stop point where the first inner thread diameter 62 of fastener 60 is less than the outer diameter of threads 50 of outer surface 36 and therefore fastener 60 can no longer be tightened.

Terminal connector 10 further includes a snap-on cover 70 which is formed of an insulating material such as a plastic material. Cover 70 comprises a generally circular shell having a notch (shown in FIG. 2) formed in a bottommost section of a portion of annular sidewall 74 of cover 70. Annular sidewall 74 of cover 70 thus has a first height at the notch and a second height in the remaining portions of annular sidewall 74 which form the side walls of the notch, wherein the first height is less than the second height. The notch is intended to receive conductor 16 proximate first end 18 at a location where first and second side edges 22 and 24 are substantially parallel to one another. The remaining portions of cover 70 which have annular sidewall 74 of the second height include an annular recess 76 formed in an inner surface 78 of cover 70 which faces post terminal 12 when cover 70 is secured to conductor 16, as illustrated in FIG. 1. Annular recess 76 is sized to receive the peripheral edge of generally circular platform 26 formed in conductor 16 so that cover 70 is secured to the arcuate peripheral edge defining generally circular platform 26.

Annular sidewall 74 further includes a beveled lip 80 which is partially defined by annular recess 76 and which serves to engage bottom surface 48 of conductor 16 in a snap-fit manner so that cover 70 is securely coupled to conductor 16 and completely encloses post terminal 12. Cover 70 snap-fits onto conductor 16 by disposing the peripheral edge of generally circular platform 26 into annular recess 76 and then engaging beveled lip 80 to bottom surface 48. When cover 70 is snap-fittingly retained on conductor 16, the portion of annular sidewall 74 above the notch seats against top surface 54 of conductor 16 between first and second parallel side edges 22 and 24 proximate first end 18. It being understood that the remaining portions of annular sidewall 74 have a portion which seats against top surface 54 of conductor 16. This portion which rests against top surface 54 actually comprises an upper wall 84 of annular recess 76. To disengage cover 70 from conductor 16, beveled lip 80 is pulled in a direction away from conductor 16 causing the peripheral edge of conductor 16 to disengage from annular recess 76. As best shown in FIG. 1, when cover 70 is securely retained to conductor 16, a top surface 88 of cover 70 is spaced from the topmost surface of post terminal 12, wherein top surface 88 and the topmost surface of post terminal 12 are generally parallel to one another.

Cover 70 may be appropriately colored to indicate whether the underlying post terminal 12 is either the positive or negative terminal. For example, it is conventionally known that the positive terminal of a battery is marked by either a red color and/or a "+" sign and the negative terminal is marked by either a black color and/or a "−" sign.

The radial convergence of the plurality of fingers 32 against post terminal 12, when fastener 60 threadingly engages sleeve 30, results in terminal connector 10 of the present invention securely gripping post terminal 12. Advantageously, terminal connector 10 further provides a mechanical hold for electronics package 17 of which conductor 16 is securely coupled thereto. Because terminal connector 10 adapts flat conductor 16 to standard automotive batter tapered post terminals 12, electronics package 17 including flat conductor 16 may be attached directly to post terminal 12, thus reducing the area which is occupied by terminal connector 10 and electronics package 17. In one aspect of the invention, terminal connector 10 is designed to provide a member for supporting the electronics package 17 proximate battery case 14.

Another advantage of the present invention is that terminal connector 10, unlike many conventional terminal connectors, is not tolerance dependent. Accordingly, terminal connector 10 can be used with post terminals 12 which have varying tolerances because to a large degree, terminal connector 10 is tolerance independent. Because sleeve 30 of terminal connector 10 receives post terminal 12 and the use of fastener 60 causes sleeve 30 to inwardly converge and tighten around post terminal 12, terminal connector 10 may be used with post terminals 12 having tapered designs of varying diameters so long as second end 42 of sleeve 30 is sized to receive post terminal 12 and fastener 60 threadingly engages sleeve 30 sufficiently so that the plurality of fingers 32 of sleeve 30 converge inward and seat against post terminal 12 to securely attach terminal connector 10 to post terminal 12. Accordingly, terminal connector 10 provides a mechanism for mechanically holding down electronics package 17 to the post terminal 12 and electrically connecting the electronics package to post terminal 12. At the same time terminal connector 10 of the present invention permits both the positive and negative terminal to be freely accessible for use, such as providing a further electrical connection between a second electrical conduit and post terminal 12.

Terminal connector 10 of the present invention is particularly well suited for use with electronics package 17 which is powered by battery 14. For example, in a preferred and exemplary embodiment, electronics package 17 is part of a smart battery 14, wherein electronics package 17 is electrically connected to the battery terminal 12. Electronics package 17 of the smart battery 14 provides the user with a variety of functions and is capable of storing and monitoring information relating to battery performance and the like. Electronics package 17 requires power to operate and thus is connected to the battery terminal. Terminal connector 10 of the present invention preferably provides an electrical connection between an internal electrical distribution assembly (not shown) within electronics package 17 and battery terminal 12.

Yet another advantage of the present invention is that terminal connector 10 is designed for top down assembly techniques for the assembly of the individual components forming terminal connector 10. Accordingly, terminal connector 10 of the present invention is easily assembled and reduces the overall complexity for assembling terminal connector 10 to post terminal 12 because of the top down assembly technique. Connector 10 also could be attached to a cable thus saving space, providing quick on/off capabilities, better connection, and a lesser expensive attachment.

It will be understood that a person skilled in the art may make modifications to the preferred embodiment shown herein within the scope and intent of the claims. While the present invention has been described as carried out in a specific embodiment thereof, it is not intended to be limited thereby but is intended to cover the invention broadly within the scope and spirit of the claims.

What is claimed is:

1. A battery post connector, comprising:

a conductor plate having a first opening formed therein;

a sleeve having an outer threaded surface, the sleeve being disposed within the first opening of the conductor plate and secured thereto, the sleeve including a second opening formed therein for receiving a post terminal of a battery; and a fastener which threadingly engages the outer threaded surface of the sleeve causing a portion of the sleeve to inwardly seat against the post terminal resulting in the sleeve and conductor plate being electrically connected to the post terminal.

2. The battery post connector as set forth in claim 1, wherein the sleeve includes an annular flange at one end, the annular flange defining a shoulder which abuts against a peripheral edge of the first opening when the sleeve is securely coupled to the conductor plate.

3. The battery post connector as set forth in claim 1, wherein the fastener comprises a tapered nut having a first inner thread diameter and a second inner thread diameter, the first inner thread diameter being greater than the second inner thread diameter.

4. The battery post connector as set forth in claim 1, wherein the second opening formed in the sleeve has the same diameter before the fastener threadingly engages the threads of the sleeve causing in the topmost portion of the sleeve to seat against the post terminal resulting in the second opening at the topmost portion having an inner diameter less than at a lowermost portion of the sleeve.

5. The battery post connector as set forth in claim 1, wherein the conductor plate is attached to an electronics package or cable.

6. The battery post connector as set forth in claim 1, wherein the conductor plate and the sleeve are secured to one another by an inertia weld process.

7. The battery post connector as set forth in claim 1, wherein the conductor plate is formed of copper or brass.

8. The battery post connector as set forth in claim 1, wherein the fastener is formed of plated steel.

9. The battery post connector as set forth in claim 1, wherein the battery comprises an automotive battery.

10. The battery post connector as set forth in claim 1, wherein the sleeve is formed of an electrically conductive material.

11. The battery post connector as set forth in claim 1, wherein the conductor plate has a first end and an opposite second end, the conductor plate including generally parallel peripheral edges at the first end, the peripheral side edges arcuately converging intermediate the first and second ends to form a generally circular platform having a diameter greater than a diameter of the topmost portion of the post terminal.

12. The battery post connector as set forth in claim 1, wherein the conductor plate has a first end and an opposite second end, the conductor plate including a generally circular platform formed at the second end.

13. The battery post connector as set forth in claim 12, wherein the first opening is centrally located in the generally circular platform.

14. The battery post connector as set forth in claim 12, wherein the sleeve comprises a split finger sleeve having a plurality of fingers defined by a plurality of slots formed within the sleeve, wherein an outer surface of the plurality of the fingers is threaded.

15. The battery post connector as set forth in claim 1, further comprising:

a cover for enclosing the post terminal, the cover comprising a shell having a cavity for receiving the post terminal.

16. The battery post connector as set forth in claim 15, wherein the cover includes a notch for receiving a portion of the conductor plate and an annular recess for receiving a peripheral edge of the conductor plate in a snap-fit manner.

17. The battery post connector as set forth in claim 16, wherein the annular recess partially defines an annular lip which engages a bottom surface of the conductor plate in a snap-fit manner.

* * * * *